United States Patent [19]

Gingerich et al.

[11] 4,417,106

[45] Nov. 22, 1983

[54] SEALED ELECTRICAL CONTACT ASSEMBLY AND ELECTRICAL SWITCH MADE THEREFROM

[75] Inventors: David J. Gingerich, Swatara; Patrick R. McCarty, New Cumberland; David T. Shaffer, Harrisburg, all of Pa.

[73] Assignee: AMP Incorporated, Harrisburg, Pa.

[21] Appl. No.: 326,723

[22] Filed: Dec. 2, 1981

[51] Int. Cl.[3] ..... H01H 19/04

[52] U.S. Cl. ..... 200/5 R; 200/6 R; 200/68; 200/67 R

[58] Field of Search ..... 200/5 R, 6 R, 6 B, 6 BA, 200/6 BB, 6 C, 339, 153 G, 67 G, 68; 29/622

[56] References Cited

U.S. PATENT DOCUMENTS

| | | | |
|---|---|---|---|
| 3,403,236 | 9/1968 | Zoludow | 200/339 X |
| 3,878,344 | 4/1975 | Lockard | 200/6 B |
| 3,902,032 | 8/1975 | Koepke | 200/159 A X |
| 4,018,999 | 4/1977 | Robinson et al. | 200/5 A |
| 4,302,637 | 11/1981 | Ditzig | 200/6 R |
| 4,311,884 | 1/1982 | Henley et al. | 200/5 R |
| 4,347,411 | 8/1982 | Diszenza et al. | 200/68 X |

FOREIGN PATENT DOCUMENTS

| | | | |
|---|---|---|---|
| 1434254 | 2/1966 | France | 200/68 |

*Primary Examiner*—Elliot A. Goldberg
*Assistant Examiner*—Morris Ginsburg
*Attorney, Agent, or Firm*—Adrian J. LaRue

[57] ABSTRACT

A sealed electrical contact assembly comprises a dielectric frame in which a plurality of aligned stationary electrical contact members are secured as opposing sets of contact members and movable electrical contact members interconnect each set of stationary contact members. One of the opposing sets of stationary contact members and the movable contact members have mateable pivot areas at which the movable contact members are mounted so that the movable contact members can be moved to a position electrically connecting the opposing sets of stationary contact members. A membrane is sealingly secured onto the frame covering each set of stationary and movable contact members associated therewith.

21 Claims, 12 Drawing Figures

SEALED ELECTRICAL CONTACT ASSEMBLY AND ELECTRICAL SWITCH MADE THEREFROM

FIELD OF THE INVENTION

This invention relates to an electrical contact assembly and more particularly to a sealed electrical contact assembly and electrical switch made therefrom for use on a printed circuit board.

BACKGROUND OF THE INVENTION

Dual in line package (DIP) switches have been used for many years. They are mounted on a printed circuit board and subjected to flow soldering to solder their pins to appropriate circuit paths on the printed circuit board. Thereafter, the soldered printed circuit board is cleaned to remove flux therefrom.

The DIP switches in undergoing the flow soldering and cleaning operations can become contaminated thereby resulting in switch failures requiring them to be replaced which is time-consuming and costly.

SUMMARY OF THE INVENTION

According to the present invention, a sealed electrical contact assembly comprises a dielectric frame in which a plurality of aligned stationary electrical contact members are secured as opposing sets of contact members and movable electrical contact members interconnect each set of stationary contact members. One of the opposing sets of stationary contact members and the movable contact members have mateable pivot areas at which the movable contact members are mounted so that the movable contact members can be moved to a position electrically connecting the opposing sets of stationary contact members. A membrane is sealingly secured onto the frame covering each set of stationary and movable contact members associated therewith.

According to another aspect of the present invention, a housing is latchably secured onto the contact-carrying frame and includes rocker members disposed therein thereby forming an electrical switch. Each of the rocker members has a spring-biased member engaging a movable contact member through the membrane. Sections of the rocker members are engageable to move the rocker members from one position moving the movable contact members via the spring-biased members to a position electrically connecting the opposing sets of stationary contact members and to another position moving the movable contact members to a position disconnecting the opposing sets of stationary contact members.

According to a further aspect of the present invention, a method of making a sealed electrical contact assembly comprises stamping a sheet of metal and forming a carrier strip having lead frames. Each of the lead frames includes a series of aligned contact members disposed as sets of opposed contact members. A dielectric contact-carrying frame is molded onto the series of aligned contact members with contact sections of the sets of opposed contact members being exposed and terminal sections extending outwardly from the frame. Movable contact members are positioned across the exposed contact sections. A membrane is sealingly secured onto the frame over the sets of opposed exposed contact sections and movable contact member associated therewith.

DETAILED DESCRIPTION OF THE PREFERRED EMBODIMENT

Figure 1:
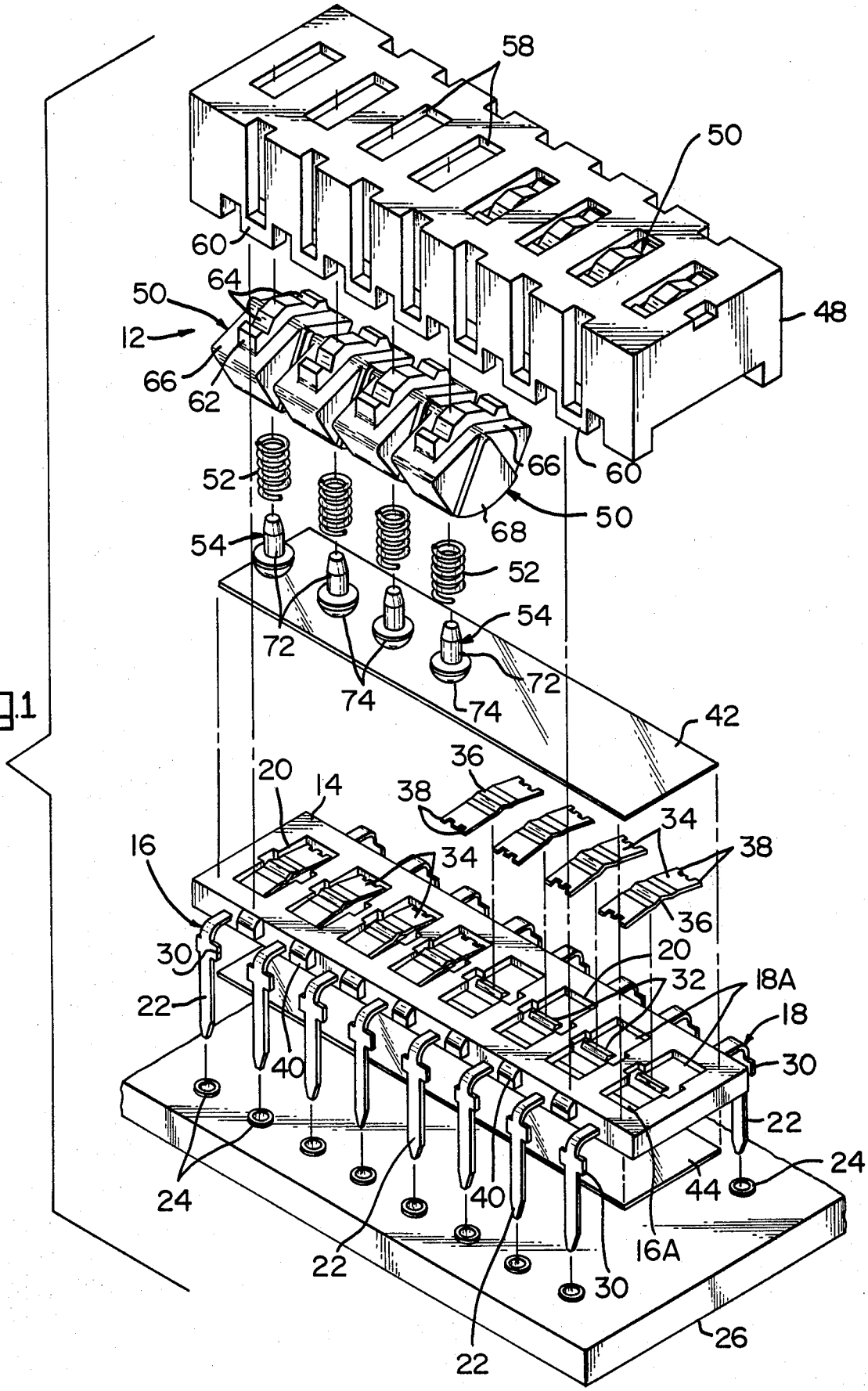
FIG. 1 is an exploded perspective view showing the various parts of the switch of the present invention.
Figure 2:
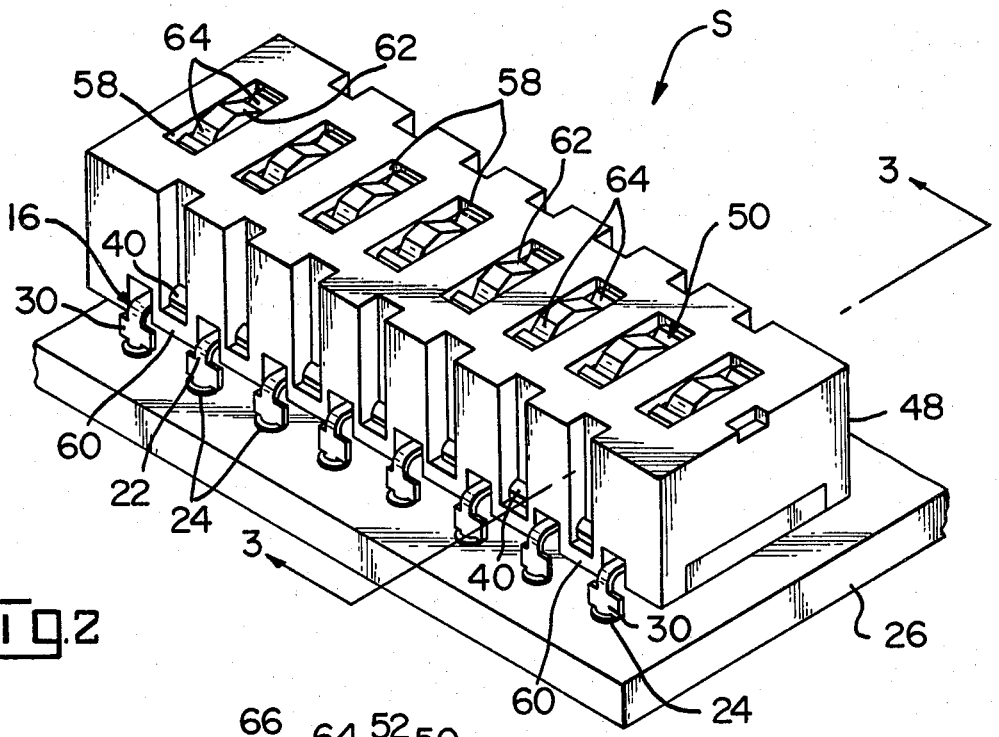
FIG. 2 is a view similar to FIG. 1 of an assembled switch.
Figure 3:
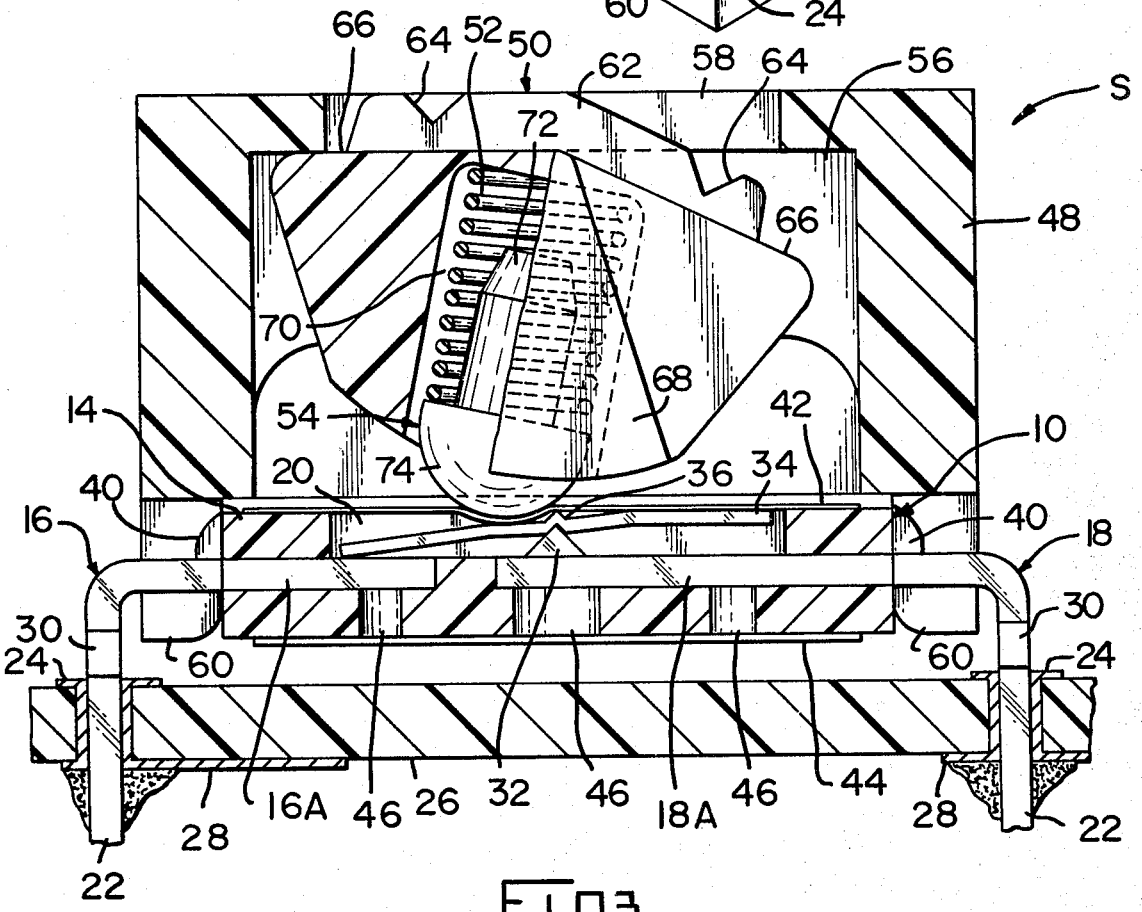
FIG. 3 is a cross-sectional view taken along line 3—3 of FIG. 2 with parts broken away.

FIGS. 1—3 illustrate the sealed electrical contact assembly 10 and the contact-actuating mechanism 12 that is latchably secured thereto thereby forming DIP switch S as illustrated in FIGS. 2 and 3. Dielectric frame 14 is molded from a suitable commercially-available plastic material and it has a series of aligned electrical contact members 16, 18 molded in place therein. Electrical contact members 16, 18 are arranged in dielectric frame 14 having opposed stationary electrical contact sections 16A, 18A which are exposed in recesses 20 in the top surface of frame 14. Each of electrical contact members 16, 18 have electrical terminal sections 22 extending outwardly from frame 14 for electrical connection with electrical sockets 24 disposed in proper alignment in printed circuit board 26 with electrical sockets 24 electrically connected to appropriate circuit paths 28 located thereon. Electrical terminal sections 22 are provided with projections 30 to limit the movement of electrical terminal sections 22 within sockets 24 in order to space switch S from board 26. Electrical contact sections 18A are provided with upwardly-directed pivot members 32 that have been stamped therefrom.

Moveable electrical contact members 34 have V-shaped embossments 36 formed therein which mate with pivot members 32 and the ends are provided with contact fingers 38 to provide contact redundancy when movable contact members 34 are moved into electrical contact with stationary contact members 16 as illustrated in FIG. 3. V-shaped embossments 36 in engagement with pivot members 32 positively position movable contact members 34 relative to the respective sets of contact members 16, 18 within recesses 20. Latching lugs 40 having beveled surfaces extend outwardly from the sides of frame 14 between terminal sections 22.

Membranes 42, 44 of a commercially-available plastic material are sealingly secured on the top and bottom surfaces of frame 14 by a commercially-available adhesive material. Membrane 42 covers all of recesses 20 with movable contact members 34 pivotally mounted on pivot members 32 of electrical contact members 18 and membrane 44 covers holes 46 in frame 14. As can be discerned, membrane 42 not only maintains movable contact members 34 in position in recesses 20 and on pivot members 32 of stationary contact members 18, but membranes 42, 44 also seal electrical contact assembly 10 from contaminants, especially during which the flow soldering and cleaning operations the contact assembly will be subjected and during their operating life. While membrane 44 is disclosed as covering the bottom surface of frame 14 to cover holes 46 therein, frame 14 can be molded without holes 46 therein thereby eliminating membrane 44 and using only membrane 42 adhered to the top surface of frame 14, if desired.

Contact-actuating mechanism 12 includes housing 48, rocker members 50, coil springs 52 and buttons 54. Housing 48, rocker members 50 and buttons 54 are molded from a commercially-available plastic material.

Housing 48 has separate cavities 56 which receive therein contact-operating members comprising rocker members 50, coil springs 52 and buttons 54 therein as illustrated in FIG. 3. Rectangular openings 58 are located in housing 48 which communicate respectively with cavities 56. Latches 60 extend outwardly from the bottom surface of housing 48 to mate with latching lugs 40 on frame 14 to latchably secure housing member 48 onto frame 14 with the contact-operating members in position in cavities 56 thereby forming switch S as illustrated in FIGS. 2 and 3.

Rocker members 50 have projections 62 on the top surfaces thereof which extend through rectangular openings 58 and they have V-shaped notches 64 therein which are engaged by a probe to move rocker members 50 from a contact-actuated position as illustrated in FIG. 3 to a non-contact-actuated position opposite to that illustrated in FIG. 3. Projections 62 are profiled so as not to extend above the top surface of housing 48 in either one of its operated positions. Inclined surfaces 66 of rocker members 50 engage the inside top surfaces of housing 48 to limit movement of rocker members 50 within cavities 56. Pie-shaped members 68 extend outwardly from each side of rocker members 50 and they along with the apex of inclined surfaces 66 define pivot members to enable rocker members 50 to operate in a reciprocal manner within cavities 56 to operate contact assembly 10. The apexes of members 68 and surfaces 66 engage the upper inside surface of housing 48 to define a pivot point therefor and the bottom arcuate surfaces of members 68 rock along the membrane-covered top surface of frame 14 when rocker members 50 are moved from one position to another.

Rocker members 50 have cavities 70 therein in which coil springs 52 and buttons 54 are disposed. Buttons 54 have a beveled shaft 72 disposed within coil springs 52 and a semi-spherical contact-operating member 74 that operates movable contact members 34 as illustrated in FIG. 3 through membrane 42. Coil springs 52 extend between contact-operating members 74 and the bottom of cavities 70 thereby exerting pressure on contact-operating members 74 causing members 74 to springably engage movable contact members 34 through membrane 42 and to urge rocker members 50 against the upper inside surface of housing 48.

Actuating mechanism 12 can be used to move a movable member 34 via rocker member 50 from one position to another with spring-biased button 54 being maintained in one or the other positions by engagement with either side of embossment 36 to maintain movable member 34 at such position and inclined surfaces 66 limit movement of the rocker member.

In operation with reference to FIG. 3, a probe (not shown) is inserted into the left-sided notch 64 for applying a force to rocker member 50. This causes the bottom arcuate surfaces of members 68 to engage the top surface of frame 14 through membrane 42 thereby causing rocker member 50 to rock about such arcuate surfaces with contact-operating member 74 being depressed inwardly against the action of coil spring 52 as it rides along V-shaped embossment 36. So long as the force applied to rocker member 50 does not enable contact-operating member 74 to extend slightly beyond the center thereof, rocker member 50 will move back to its original position. If the operating force exerted by the probe is sufficient to move contact-operating member 74 via rocker member 50 beyond the center of contact-operating member 74, the configuration of embossment 36 on pivot member 32 and that of contact-operating member 74 plus the action of coil spring 52 will move rocker member 50 to the other position from where it was located thereby providing snap action operation. Fingers 38 of movable contact members 34 are wipingly moved along stationary contact section 16A because of the downwardly bent orientation of the section of the movable contact members that begins at a location spaced outwardly from embossments 36.

The construction of DIP switch S with membrane 42 in sealed engagement with the top surface of frame 14 or with membranes 42, 44 in sealed engagement with the top and bottom surfaces of frame 14 provides a DIP switch having a sealed electrical contact assembly that will protect the contact assembly from contaminants when the board 26 is subjected to conventional flow soldering and cleaning operations as well as during the normal operating life of the switch. The DIP switch S is also smaller in all dimensions than existing DIP switches thereby enabling it to be used in greater density at a lower profile.

Figure 4:
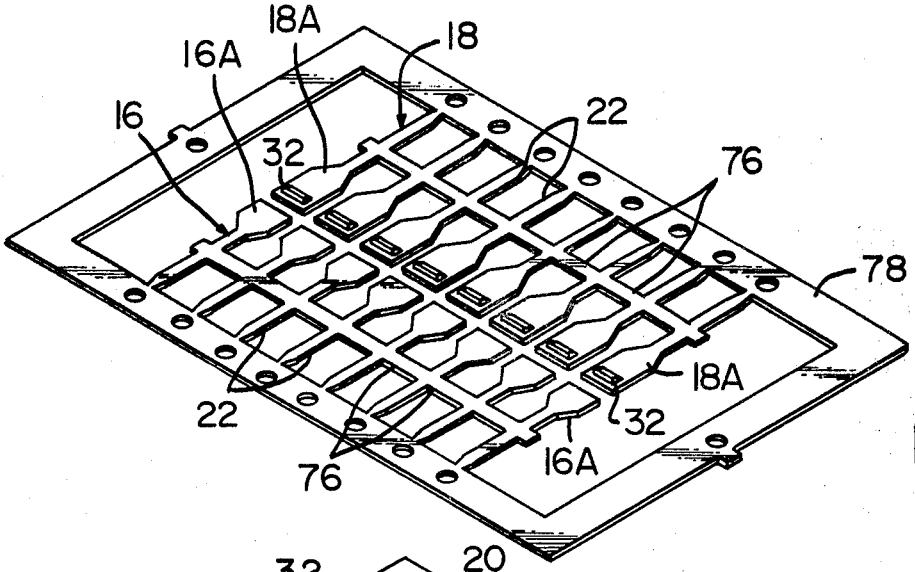
FIGS. 4–12 illustrate the various steps in making the sealed electrical contact assembly which is then latched to a housing having contact-actuating members therein thereby completing the making of a switch.

FIGS. 4–12 illustrate the method of making the sealed electrical contact assembly and the switch. Electrical contact members 16, 18 are stamped and formed from a suitable metal such as, for example, brass or the like in the form of a lead frame as illustrated in FIG. 4 with terminal sections 22 being connected together by sections 76 and their ends connected to the sides of carrier strip 78. Only one carrier strip 78 having the lead frame therein is shown, but the carrier strip is a continuous strip of stamped and formed lead frames with the carrier strip 78 providing a means for carrying the lead frames through gold or other precious metal plating and the manufacturing steps of making the sealed electrical contact assembly and switch made therefrom.

Figure 5:
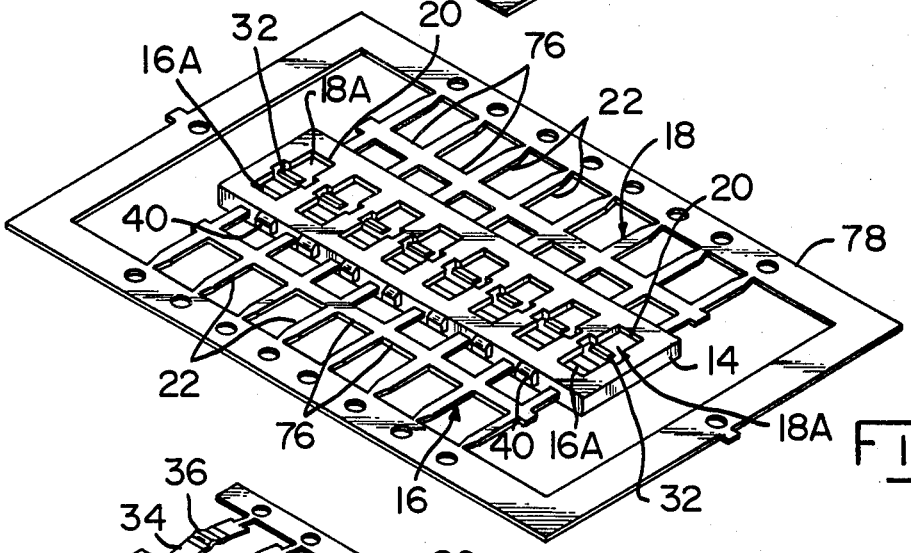
Figure 6:
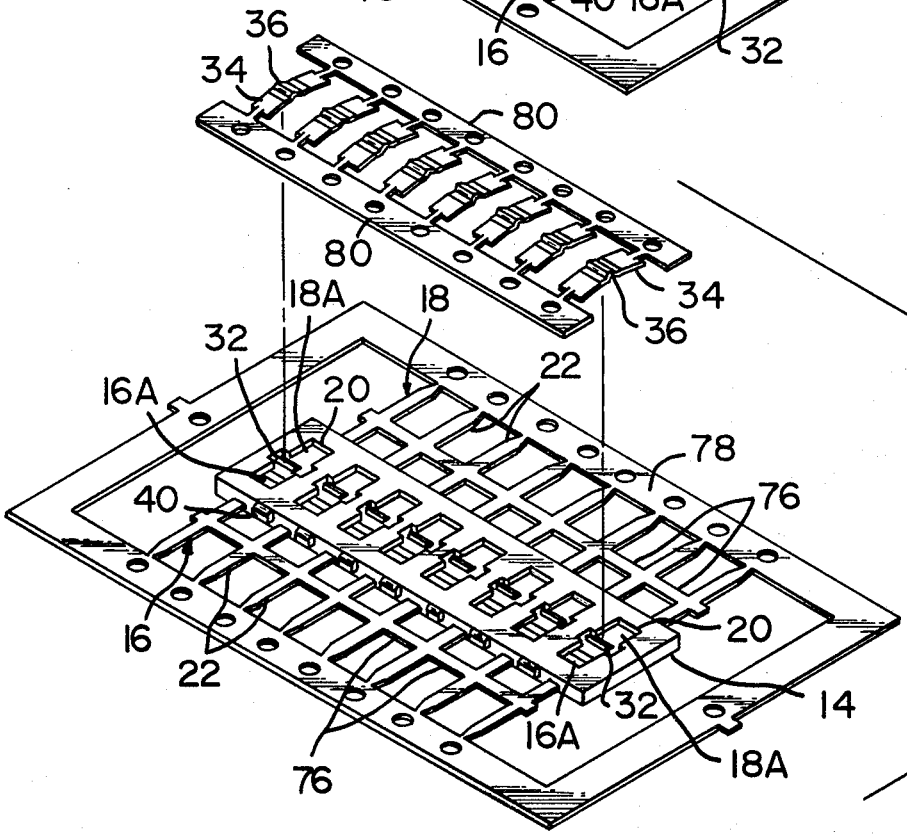
Figure 7:
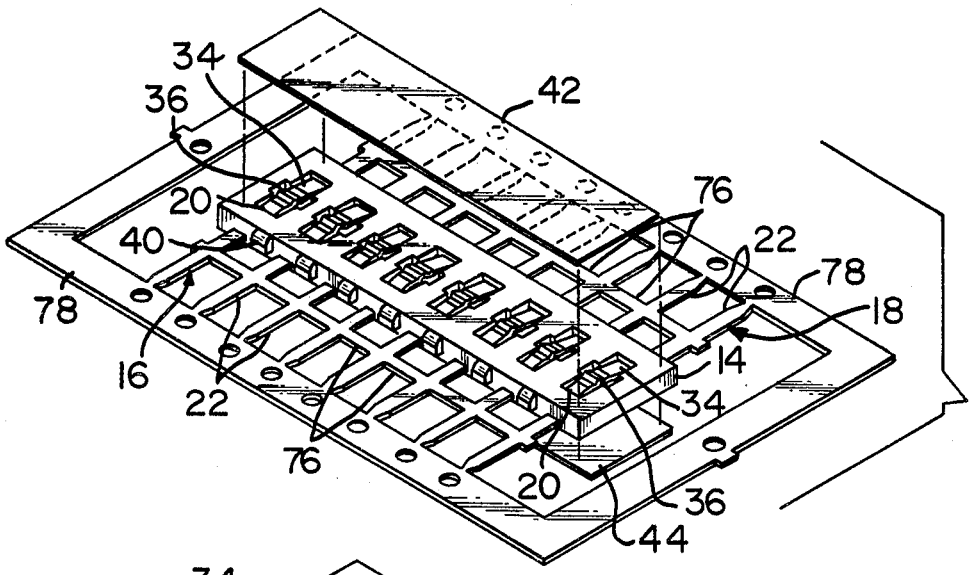

The lead frame is placed in a conventional mold and dielectric frame 14 is molded thereon with recesses 20 formed therein to expose exposed contact sections 16A, 18A of contact members 16, 18 as shown in FIG. 5. Another carrier strip 80 has the ends of gold or other precious metal plated movable contact members 34 connected thereto as shown in FIG. 6 which are sheared from carrier strip 80 and then transferred into recesses 20 of frame 14 as shown in FIG. 7 so that V-shaped embossments 36 are positioned onto pivot members 32 of contact members 18. The transferring can be done by transferring members connected to a vacuum. The lead frame 78 and strip 80 of movable contact members 34 can be chemically milled or made in any other conventional manner.

Figure 8:
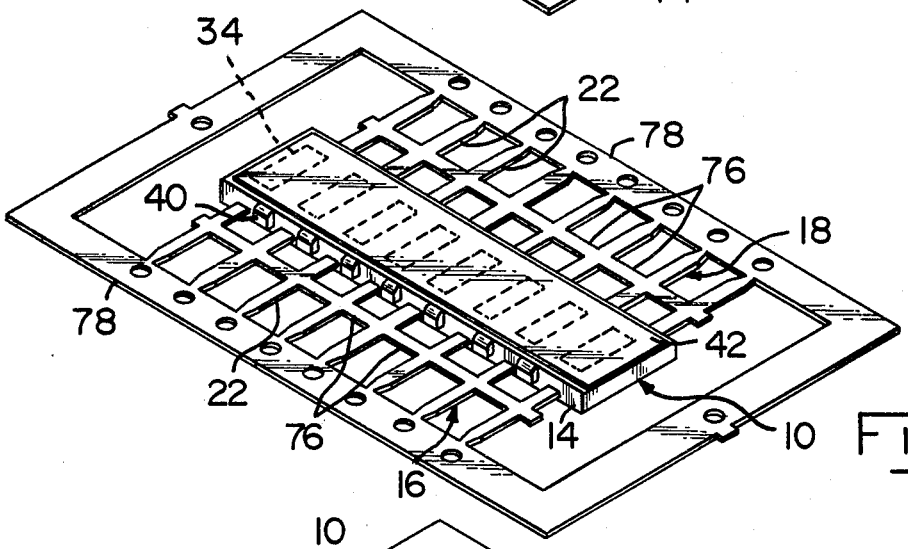
Figure 9:
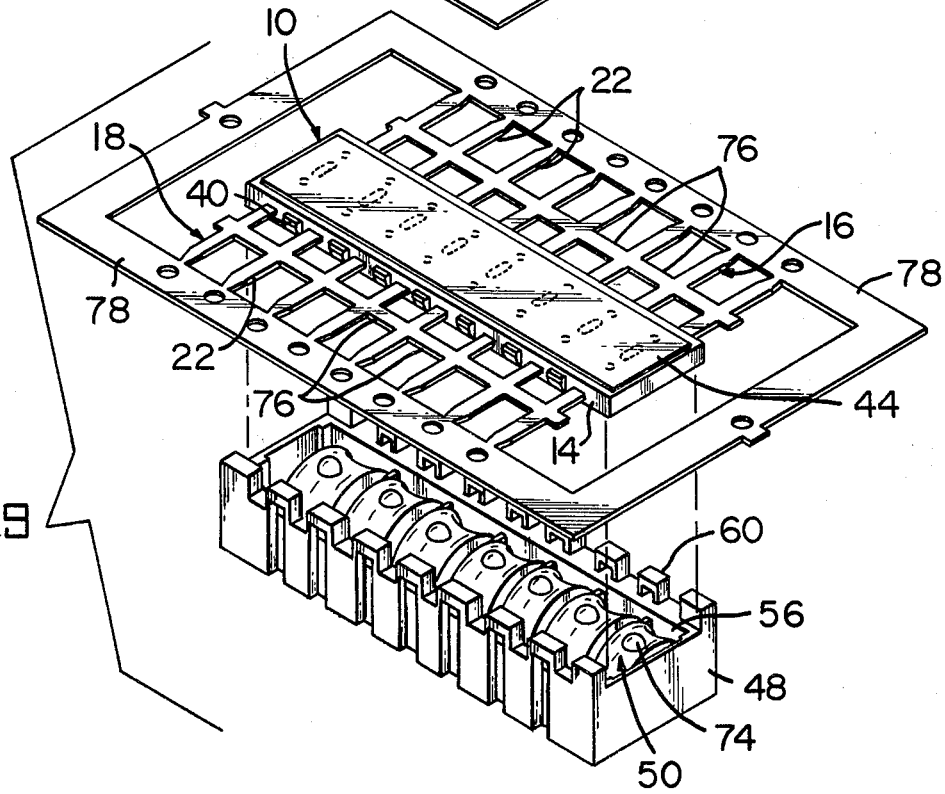
Figure 10:
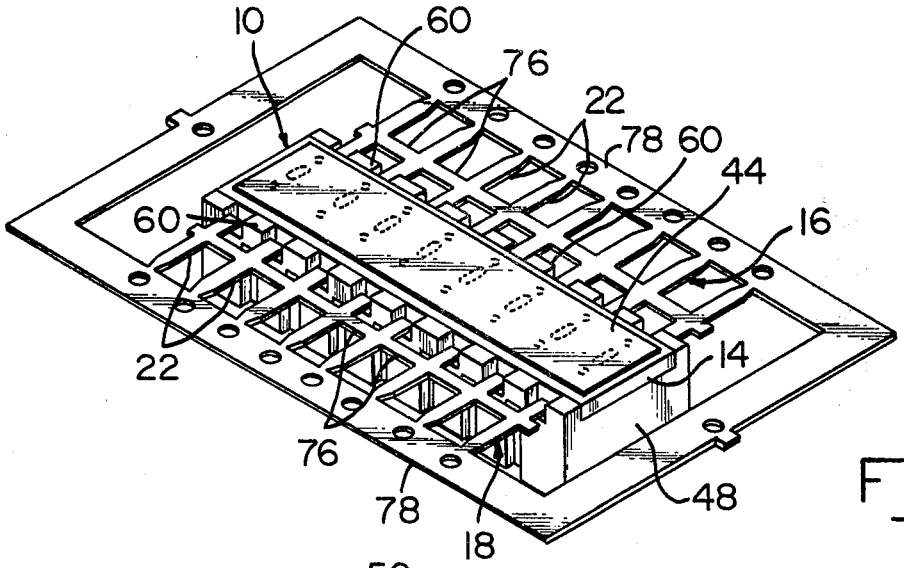
Figure 11:
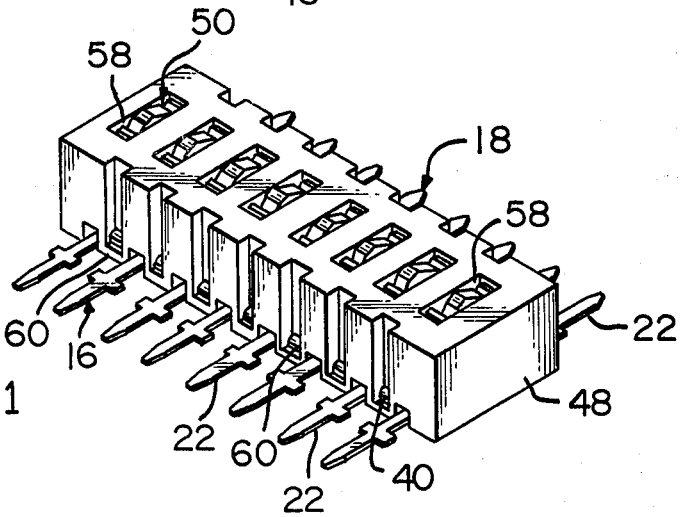
Figure 12:
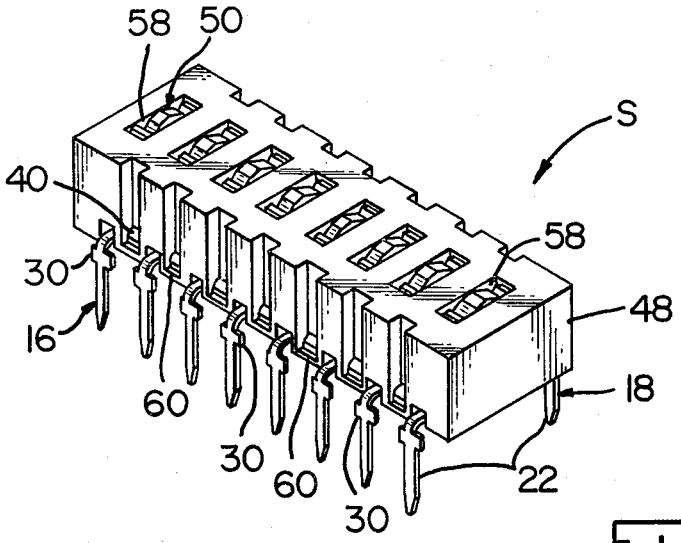

Membranes 42, 44 are then adhesively and sealingly secured onto the top and bottom surfaces of frame 14 as shown in FIG. 8. Membrane 42 maintains movable contact members 34 in position in recesses 20. FIG. 8 illustrates the completed sealed electrical contact assembly 10 which is inverted as shown in FIG. 9 and latchably secured onto housing 48 having the contact-operating members positioned in cavities 56 thereof via latches 60 latchably engaging latching lugs 40 as shown in FIG. 10. Sections 76 are sheared from between terminal sections 22 and the ends of terminal sections 22 are sheared from carrier strip 78 as shown in FIG. 11 and then bent into a proper orientation for mateable engagement with sockets 24 of board 26. The completed electrical DIP switch S, as illustrated in FIG. 12, can then be tested and packaged in tubes in the same manner as integrated circuits and they can be loaded into printed circuit boards by automated insertion equipment. Adjacent members 68 can be interconnected when formed or via a suitable adhesive and cavities 56 so profiled to enable gang switching if desired.

What is claimed is:

1. An actuating mechanism comprising:

housing means having a top, bottom and sides, said housing means having opening means in said top;

actuating means mounted in said housing means;

pivot means on said actuating means and said housing means pivotally mounting said actuating means for reciprocal movement;

pivot member means on said bottom;

movable member means having embossment means with said embossment means engaging said pivot member means enabling said movable member means to pivot thereabout;

spring biased means mounted in said actuating means engaging said movable member means on one side of said embossment means to maintain said movable member means in one position, to maintain said movable member means in another position when said actuating means moves said spring-biased means to the other side of said embossment means in engagement therewith and urging said pivot means of said actuating means against said housing means to maintain said pivot means of said actuating means and housing means in engagement; and operating means of said actuating means extending through said opening means of said top for operating said actuating means about said pivot means to move said spring-biased means along said movable member means from the one side of said embossment means to the other side thereof.

2. An actuating mechanism as set forth in claim 1 wherein said actuating means comprises stop means engageable with said housing means to limit movement of said actuating means.

3. An actuating mechanism as set forth in claim 2 wherein said stop means comprise inclined surfaces meeting at an apex, said pivot means comprising pie-shaped means having apexes coincident with said apex, said apexes engaging an inside surface of said top.

4. An actuating mechanism as set forth in claim 1 wherein said spring-biased means comprises button means disposed in a cavity in said actuating means and coil spring means extending between a bottom surface of said cavity and said button means.

5. An actuating mechanism as set forth in claim 4 wherein said bottom of said housing means includes recess means having exposed stationary electrical contact means, one of said electrical contact means including said pivot member means on which said embossment means of said movable member means defining movable electrical contact means is pivotally mounted.

6. An actuating mechanism as set forth in claim 5 wherein membrane means is sealingly secured onto said bottom covering said recess means and sealing said stationary contact means and movable contact means.

7. An electrical switch, comprising:

dielectric frame means having upper surface means in which recess means are located;

stationary electrical contact means secured in said frame means and including opposed sets of stationary contact section means respectively disposed within said recess means, one of the opposed sets of stationary contact section means having pivot means;

movable electrical contact means having complementary pivot area means pivotally mounted on said pivot means so that said movable contact means is pivoted between a first position for electrically connecting said opposed sets of stationary contact section means and to a second position for electrically disconnecting said opposed sets of stationary contact section means, said pivot area means maintaining said movable contact means on said pivot means and within said recess means;

housing means secured onto said frame means;

contact-operating means mounted in said housing means in operative association with respective ones of said movable contact means, said contact-operating means including movable means and contact-engaging means, said movable means movably mounted in said housing means for movement between said first position and said second position, said contact-engaging means comprising spring-biased means disposed in said movable means and in engagement with said movable contact means for moving said movable contact means to said first position or said second position when said movable means is moved to said first position or said second position.

8. An electrical switch as set forth in claim 7 wherein said frame means includes membrane means sealingly secured on said upper surface means, said spring-biased means engaging said movable contact means through said membrane means.

9. An electrical switch as set forth in claim 8 wherein said frame means also includes further membrane means sealingly secured to a bottom surface of said frame means.

10. An electrical switch as set forth in claim 7 wherein said stationary electrical contact means have terminal section means for electrical connection with socket means in a circuit board.

11. An electrical switch as set forth in claim 7 wherein free ends of said movable electrical contact means have contact finger means.

12. An electrical switch as set forth in claim 7 wherein latch means are included on said frame means and said housing means latchably securing said housing means and said frame means together.

13. An electrical switch as set forth in claim 7 wherein said movable means comprise rocker means having pivot means engaging an inside surface of said housing means, said rocker means including cavity means therein, spring means mounted in said cavity means along with said contact-engaging means so that said spring means urges said contact-engaging means in engagement with said movable contact means and said pivot means in engagement with said inside surface of said housing means.

14. An electrical switch as set forth in claim 13 wherein said pivot means are in the form of pie-shaped means extending outwardly from each side of said rocker means.

15. An electrical switch as set forth in claim 13 wherein said housing means includes recess means, said rocker means include projection means positioned within said recess means due to the spring bias of said spring means, notch means in said projection means for engagement by a probe to move said rocker means from said first position to said second position or vice versa.

16. An electrical switch as set forth in claim 14 wherein said rocker means include shoulder means for engagement with said inside surface of said housing means to limit movement of said rocker means in said first position and said second position.

17. A sealed electrical contact assembly, comprising:

dielectric frame means having upper surface means in which recess means are located;

stationary electrical contact means secured in said frame means and including opposed sets of stationary contact section means respectively disposed within said recess means, one of the opposed sets of stationary contact section means having pivot means;

movable electrical contact means having complementary pivot area means pivotally mounted on said pivot means so that said movable contact means is pivoted between a first position for electrically connecting said opposed set of stationary contact section means and to a second position for electrically disconnecting said opposed sets of stationary contact section means, said pivot area means maintaining said movable contact means on said pivot means and within said recess means; and membrane means sealingly secured on said upper surface means and covering said recess means and movable contact means and opposed sets of stationary contact section means therein thereby maintaining said movable electrical contact means on said pivot means.

18. A sealed electrical contact assembly as set forth in claim 17, wherein other membrane means is sealingly secured to bottom surface means of said frame means.

19. A sealed electrical contact assembly as set forth in claim 17, wherein a housing member is latchably secured onto said frame means, and movable members disposed in said housing member and including spring-biased members engaging respective movable contact means through said membrane means, sections of said movable members are engageable to move said movable members from one position moving said movable contact means via said spring-biased members to the first position electrically connecting the opposing sets of stationary contact section means and to the second position moving said movable contact means to the position disconnecting the opposing sets of stationary contact section means.

20. A sealed electrical contact assembly as set forth in claim 17, wherein the free ends of said movable contact means have contact fingers.

21. A sealed electrical contact assembly as set forth in claim 17, wherein said stationary contact means have terminal section means for electrical connection with circuit paths on a printed circuit board.

* * * * *